US006755672B2

(12) United States Patent
Lai et al.

(10) Patent No.: US 6,755,672 B2
(45) Date of Patent: Jun. 29, 2004

(54) CONNECTOR PROTECTION COVER STRUCTURE

(75) Inventors: Shih Yung Lai, Hsichih (TW); Lee Jen Wu, Hsichih (TW); Chung Hao Chen, Hsichih (TW); Chih Cheng Wang, Hsichih (TW)

(73) Assignee: Nextronics Engineering Corp., Taipei Hsien (TW)

( * ) Notice: Subject to any disclaimer, the term of this patent is extended or adjusted under 35 U.S.C. 154(b) by 0 days.

(21) Appl. No.: 10/300,772

(22) Filed: Nov. 21, 2002

(65) Prior Publication Data

US 2004/0102068 A1 May 27, 2004

(51) Int. Cl.[7] ..... H01R 13/44
(52) U.S. Cl. ..... 439/135; 174/138 F; 206/706
(58) Field of Search ..... 439/135, 207, 439/208, 892, 940; 206/706; 174/138 F

(56) References Cited

U.S. PATENT DOCUMENTS 4,197,945 A * 4/1980 Sherwood ..... 206/706
4,795,354 A * 1/1989 Owen ..... 439/137
5,340,339 A * 8/1994 Desai et al. ..... 439/892
5,688,133 A * 11/1997 Ikesugi et al. ..... 439/135
6,188,581 B1 * 2/2001 Daoud ..... 361/752
6,371,776 B1 * 4/2002 Li et al. ..... 439/135
6,599,140 B1 * 7/2003 Chen et al. ..... 439/135
2003/0027445 A1 * 2/2003 Carney et al. ..... 439/135

FOREIGN PATENT DOCUMENTS

FR 2578109 * 2/1985

* cited by examiner

*Primary Examiner*—Michael C. Zarroli
(74) *Attorney, Agent, or Firm*—Browdy and Neimark, P.L.L.C.

(57) ABSTRACT

A protection cover integrally formed of plastic by molding ejection is provided. An elastic locking structure is disposed at two sides of the protection cover. An abutting portions having a '<'-shaped part and a '>'-shaped part is formed on the locking structure to abut against the outer edge wall of the connector so that the protection cover and the connector can be firmly connected together. Reinforcement portions are formed at the inner top face and the link positions at two inner sides of the protection cover.

4 Claims, 5 Drawing Sheets

CONNECTOR PROTECTION COVER STRUCTURE

FIELD OF THE INVENTION

The present invention relates to an improved connector protection cover structure and, more particularly, to an improved connector protection cover structure, which can protect a connector, and can be conveniently connected with or separated from the connector.

BACKGROUND OF THE INVENTION

Nowadays, along with higher and higher use frequency of computers by common people, the requirements of processing, execution, contents, and equipments of computers become more and more stringent. In order to let computers be more diversified, products related to computers like mice, keyboards, digital still cameras, scanners, modems, and printers have been continually developed. All the above products utilize connectors to connect with computers. Therefore, in order to let connectors have good quality, connector protection covers have been provided to protect the connectors.

As shown in FIGS. 1 and 2, a protection cover 11 integrally formed of several plastic by molding ejection and a corresponding connector 12 are connected together to protect terminals 121 in the connector 12 and avoid deformation of the terminals due to transportation or stacking, hence increasing the yield of the connector 12.

However, the above connector protection cover 11 has at least the following drawbacks in use.

(1) Because the terminals 121 of the connector 12 are separately arranged and form several blocks, the protection cover 11 needs to correspond to the terminals 121 of the blocks. Therefore, it is necessary to increase greatly the number of the protection covers 11.

(2) The connector 12 and the protection cover 11 are U-shaped and inversely U-shaped, respectively. After they are connected together, there is no gap. Therefore, there is difficulty in separating the connected connector 12 and protection cover 11. It is necessary to take advantage of a professional tool (e.g., a screwdriver).

(3) When the professional tool is inserted between the connector 12 and the protection cover 11, the wall edge of the connector may easily be damaged.

(4) Because the inversely U-shaped protection cover 11 is inserted into the inner edge of the U-shaped connector 12, the terminals 121 may easily deform.

(5) When the inversely U-shaped protection cover 11 is formed by molding ejection, because there is no buffer region, it may easily tilt and deform, hence lowering the yield.

(6) Decrease of the yield not only wastes the material, but also increases the production cost.

Accordingly, the above conventional connector protection cover has inconvenience and drawbacks in practical installation and use. The present invention aims to resolve the problems in the prior art.

SUMMARY OF THE INVENTION

The primary object of the present invention is to provide an improved connector protection cover structure to effectively increase the yield in manufacturing the protection cover integrally formed of plastic by molding ejection, thereby saving the material and lowering the production cost. Moreover, the strength of the top face of the protection cover can be reinforced to facilitate stacking of the connectors during transportation.

Another object of the present invention is to provide an improved connector protection cover structure, whereby a connector can be separated from the protection cover without any professional tool (e.g., a screwdriver). Therefore, scrapes on the surface of the connector can be avoided.

To achieve the above objects, the present invention provides an improved connector protection cover structure, wherein an elastic locking structure is disposed at two sides of the protection cover. An abutting portions having a '<'-shaped part and a '>'-shaped part is formed on the locking structure to abut against the outer edge wall of the connector so that the protection cover and the connector can be firmly connected together.

The present invention also provides an improved connector protection cover structure, wherein reinforcement portions are formed at the inner top face and two inner sides of the protection cover to effective increase the strength of the top face of the protection cover, hence preventing the inner top face of the protection cover from crushing the terminals due to stacking of the connectors.

The various objects and advantages of the present invention will be more readily understood from the following detailed description when read in conjunction with the appended drawing, in which:

DETAILED DESCRIPTION OF THE PREFERRED EMBODIMENTS

Figure 1:
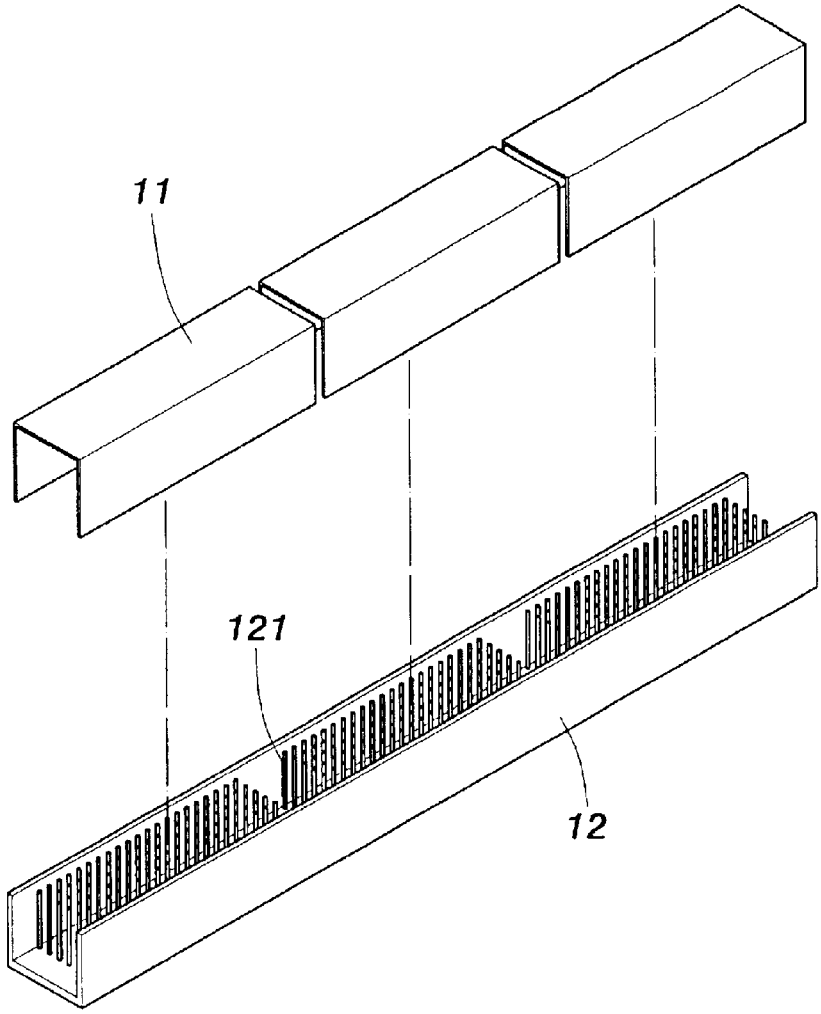
FIG. 1 PRIOR ART
FIG. 1 is an exploded perspective view of a connector and a protection cover in the prior art.
Figure 2:
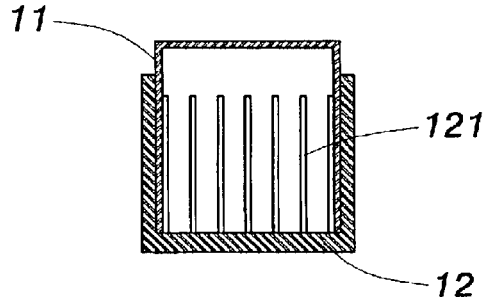
FIG. 2 PRIOR ART
FIG. 2 is a cross-sectional assembly view of a connector and a protection cover in the prior art.
Figure 3:
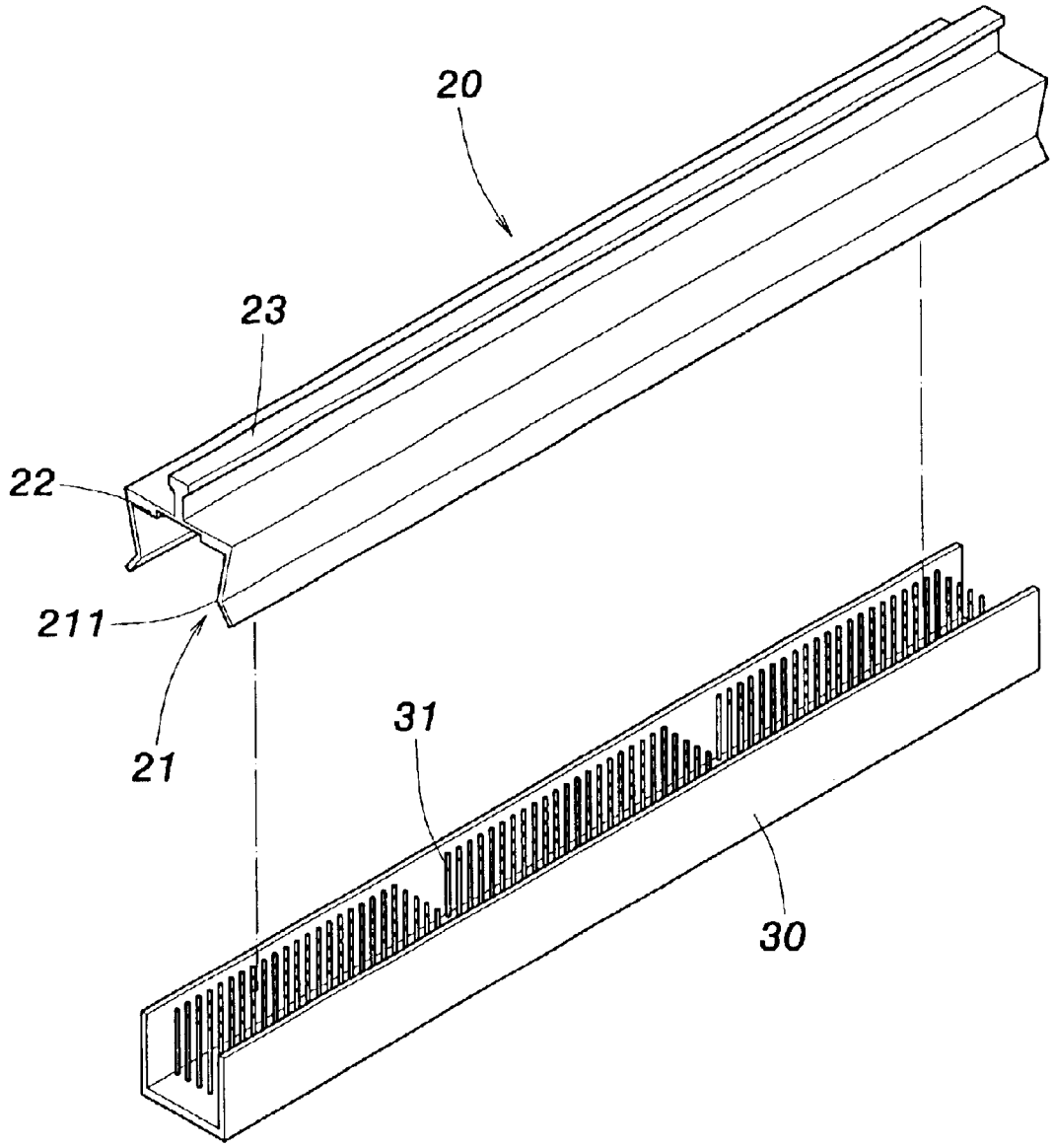
FIG. 3 is an exploded perspective view of the present invention and a connector.
Figure 4:
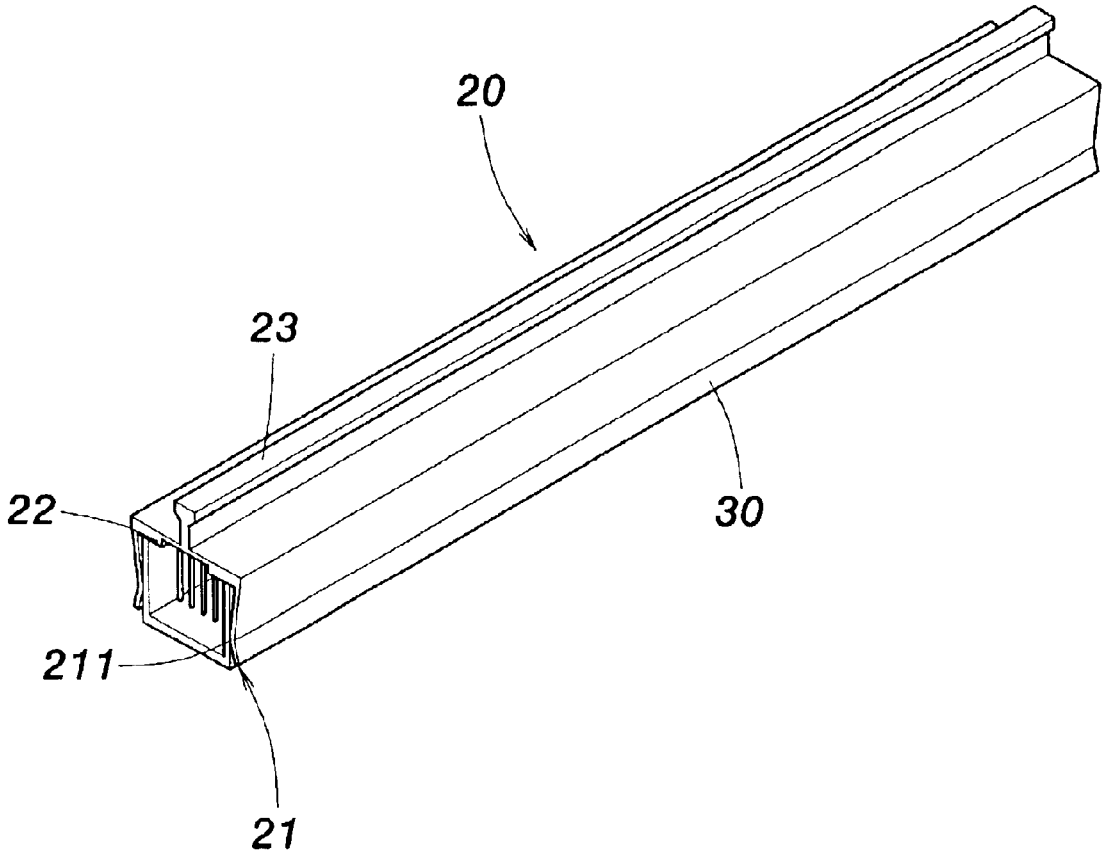
FIG. 4 is a perspective assembly view of the present invention and a connector.

As shown in FIGS. 3 and 4, the present invention relates to an improved connector protection cover structure and, more particularly, to an improved connector protection cover structure, which can be conveniently connected with or separated from a connector to protect the connector. The present invention is a protection cover 20 integrally formed of plastic by molding ejection. The protection cover 20 is connected with a corresponding connector 30 to protect terminals 31 in the connector 30 and avoid deformation of the terminals due to transportation or stacking, hence increasing the yield of the connector 30. The above structure is the same as the prior art and thus will not be further described.

Figure 5:
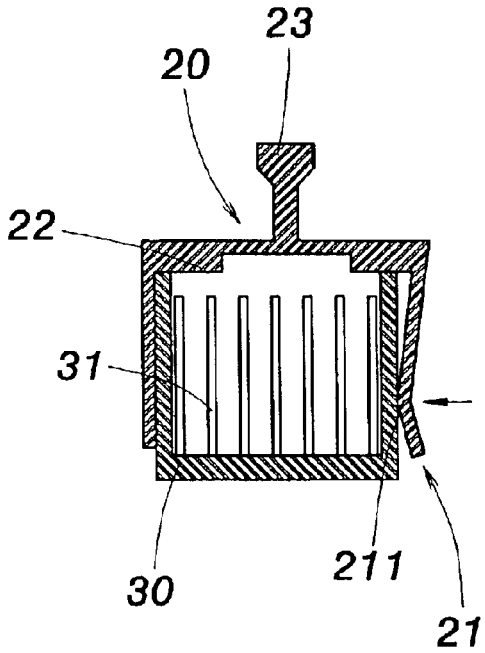
FIG. 5 is a cross-sectional assembly view of the present invention and a connector.

As shown in FIGS. 3, 4, and 5, the protection cover 20 is inversely U-shaped to correspond to the U-shaped connector 30 for connection.

A projective piece 23 and an elastic locking structure 21 are disposed at the top face and two sides of the protection cover 20, respectively. The projective piece 23 is used to separate the protection cover 20 from the connector 30. The locking structure 21 is an elastic sheet body. An abutting portion 211 is formed on the locking structure 21. The abutting structure 211 has a '<'-shaped part and a '>'-shaped part.

The abutting portion 211 can abut against the outside of the U-shaped connector with its only elasticity (as shown in FIG. 5) so that the protection cover 20 and the connector 30 can be firmly connected together.

Moreover, because the protection cover 20 is integrally formed of plastic by molding ejection, a buffer region will be formed when forming the abutting portion 211, hence avoiding generation of tilt and deformation. Therefore, the yield can be increased to save the material and lower the production cost.

Besides, reinforcement portions 22 are formed at the inner top face and the link positions at two inner sides of the protection cover 20. The reinforcement portions 22 can effectively enhance the strength of the top face of the protection cover 20 to prevent the inner top face of the protection cover 20 from crushing the terminals 31 due to stacking of the connector 30.

Figure 6:
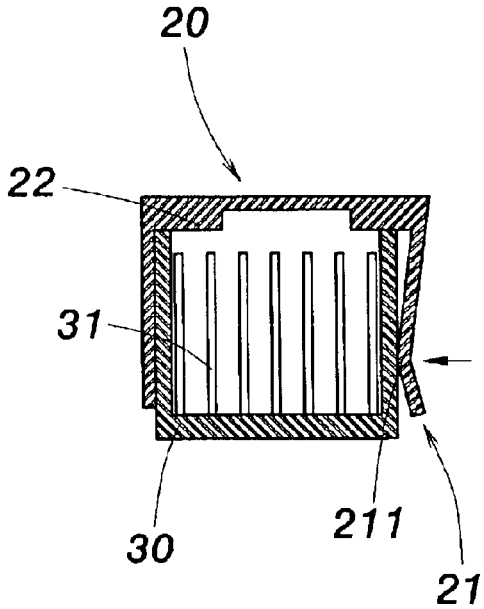
FIG. 6 is a cross-sectional assembly view of another embodiment of the present invention and a connector.

As shown in FIG. 6, the projective piece in FIG. 3 can be saved. When the protection cover 20 and the connector 30 are separated, two sides of the protection cover 20 can be exploited for direct extraction.

Figure 7:
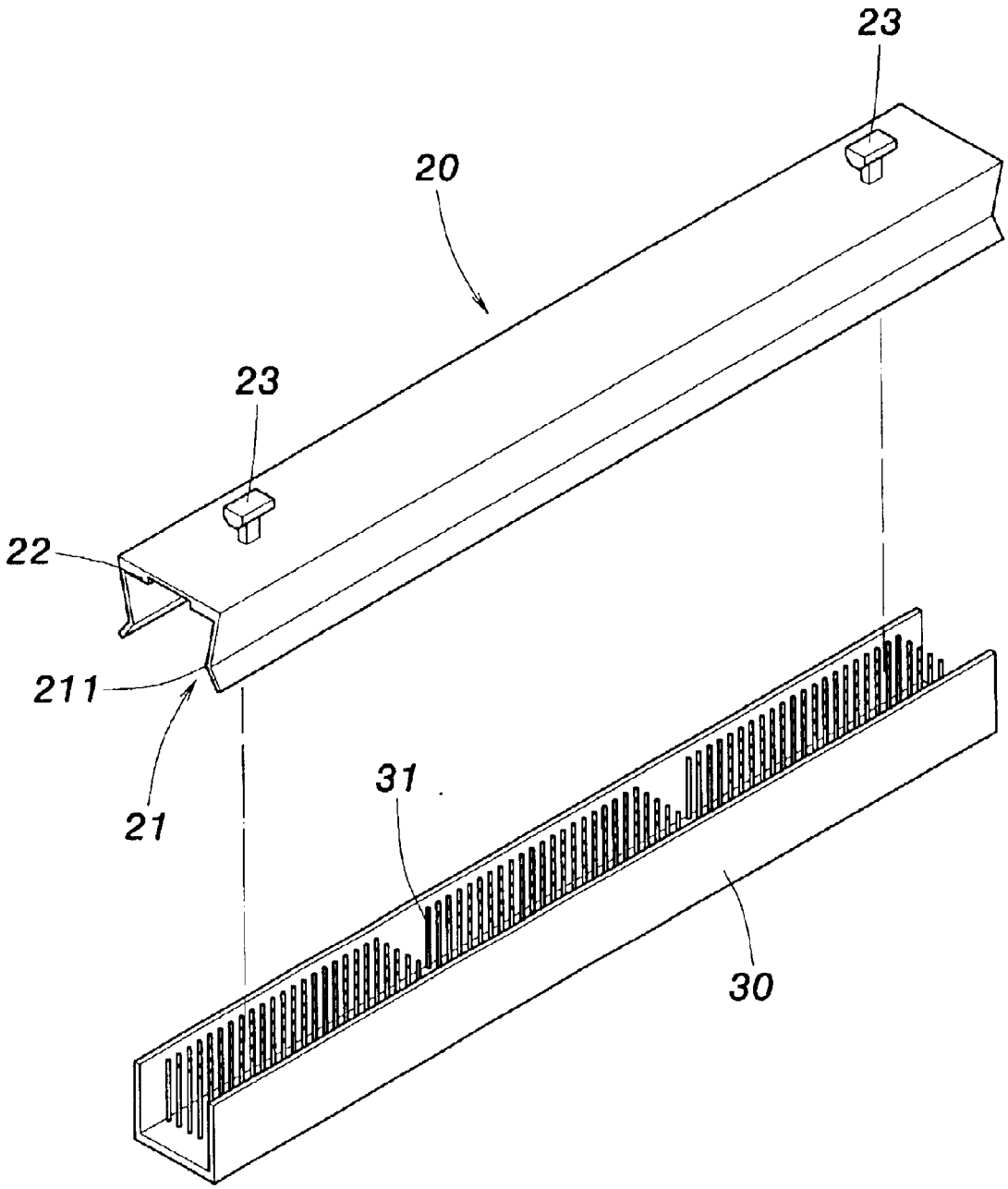
FIG. 7 is an exploded perspective view of yet another embodiment of the present invention and a connector.

As shown in FIG. 7, the projective piece 23 in FIG. 3 can be several projective ears to facilitate separation of the protection cover 20 from the connector 30.

To sum up, the improved connector protection cover of the present invention has the following advantages.

(1) The elastic locking structure 21 formed at two sides of the protection cover 20 abuts against the U-shaped connector 30 so that the protection cover 20 and the connector 30 can be firmly connected together.

(2) The abutting portion 211 has a '<'-shaped part and a '>'-shaped part to facilitate separation of the protection cover 20 from the connector 30. Moreover, scrapes on the surface of the connector 30 can be avoided.

(3) A buffer region is formed when the abutting portion 211 is formed of plastic by molding ejection, hence avoiding tilt and deformation. The yield can thus be increased. Moreover, the material can be saved and the production cost can be lowered.

(4) The reinforcement portions 22 are formed at the inner top face and the link positions at two inner sides of the protection cover 20 to effectively enhance the strength of the top face of the protection cover 20, hence preventing the inner top face of the protection cover 20 from crushing the terminals 31 due to stacking of the connector 30.

Using the present inventive construction, it is not necessary to use a professional tool like a screwdriver to separate the protection cover from the connector. Scrapes on the surface of the connector can also be avoided. Further, the reinforcement portions are formed at the inner top face at two inner sides of the protection cover to prevent the protection cover from crushing terminals in the connector due to stacking of the connectors during transportation.

Although the present invention has been described with reference to the preferred embodiment thereof, it will be understood that the invention is not limited to the details thereof. Various substitutions and modifications have been suggested in the foregoing description, and other will occur to those of ordinary skill in the art. Therefore, all such substitutions and modifications are intended to be embraced within the scope of the invention as defined in the appended claims.

Reference Numerals

| | |
|---|---|
| Prior art | |
| 11: protection cover | 12: connector |
| 121: terminal | |
| Present invention | |
| 20: protection cover | |
| 21: locking structure | 211: abutting portion |
| 22: reinforcement portion | 23: projective piece |
| 30: connector | 31: terminal |

What is claimed is:

1. A protection cover structure adapted for an electrical connector having a plurality of terminals arranged between two side walls thereof, comprising:

a cover body integrally formed in one piece to define a predetermined length for completely sealing on the terminals of the electrical connector, and the cover body having an elastic locking structure disposed at two sides thereof, and a reinforcement structure having two reinforcement portions formed on a top inner surface thereof for abutting against top ends of the two side walls of the electrical connector respectively;

the elastic locking structure having two abutting portions for abutting against outside surfaces of the two side walls of the electrical connector, thereby to securely couple the cover body and the electrical connector;

the reinforcement structure having a thickness larger than that of the elastic locking structure; and at least one protective piece disposed at a top outer surface of the cover body for easily separating the cover body and the electrical connector.

2. The protection cover structure as claimed in claim 1, wherein said protection cover in inversely U-shaped.

3. The protection cover structure as claimed in claim 1, wherein each of said abutting portions has a one of a '<'-shaped part or a '>'-shaped part, respectively.

4. The protection cover structure as claimed in claim 1, wherein said at least one projective piece comprises at least a projective ear is disposed at a top face of said protection cover.

* * * * *